United States Patent [19]

Lefebvre et al.

[11] 4,134,260

[45] Jan. 16, 1979

[54] AFTERBURNER FLOW MIXING MEANS IN TURBOFAN JET ENGINE

[75] Inventors: Arthur H. Lefebvre, Lafayette; Samuel B. Reider, Indianapolis; Jerry G. Tomlinson, Speedway, all of Ind.

[73] Assignee: General Motors Corporation, Detroit, Mich.

[21] Appl. No.: 845,423

[22] Filed: Oct. 25, 1977

[51] Int. Cl.[2] ..... F02K 3/10; F02K 3/02

[52] U.S. Cl. ..... 60/261; 60/262

[58] Field of Search ..... 60/261, 262, 39.72 R

[56] References Cited

U.S. PATENT DOCUMENTS

| | | | |
|---|---|---|---|
| 2,934,895 | 5/1960 | Gregory et al. | 60/39.72 R |
| 2,978,865 | 4/1961 | Pierce | 60/261 |
| 3,264,822 | 8/1966 | Lane et al. | 60/39.72 R |
| 3,540,216 | 11/1970 | Quillevere et al. | 60/39.72 R |
| 3,747,345 | 7/1973 | Markowski | 60/262 |

FOREIGN PATENT DOCUMENTS

| | | | |
|---|---|---|---|
| 510584 | 3/1955 | Canada | 60/39.72 R |

*Primary Examiner*—Robert E. Garrett
*Assistant Examiner*—Thomas I. Ross
*Attorney, Agent, or Firm*—J. C. Evans

[57] ABSTRACT

A short length afterburner assembly for a jet propulsion engine having a fan bypass includes cold and hot air cross-over passages and a plurality of flame stabilization swirler vanes associated with a balanced load controller for positioning the vanes parallel to hot gas stream flow from a jet engine core when the afterburner is off and in an inclined position to such gas stream flow when fuel is injected therein during afterburner operation thereby to produce flame spread within the afterburner core by a combination of translatory and swirling motions; and wherein atomized fuel for afterburner combustion is injected into hot gases ducted through hot air cross-over passages from the jet engine core to produce pre-mix and prevaporization of fuel upstream of fixed flame-holders and wherein cold fan bypass air cross-over passages have movable turbulator grids positioned during afterburner operation for mixing cold air flow with the bypassed hot core gas at the fixed flameholders during afterburner operation and wherein the turbulator grids are positioned parallel to gas flow when the afterburner is not in operation by means of the balanced load controller to produce a balanced variable geometry mechanical load to that on the flame stabilization swirler vanes.

3 Claims, 6 Drawing Figures

AFTERBURNER FLOW MIXING MEANS IN TURBOFAN JET ENGINE

This invention relates to afterburner assemblies for association with jet propulsion engines and more particularly to afterburner assemblies for association with jet propulsion engines having a fan bypass in association therewith.

One afterburner design for association with fan bypass jet propulsion engines includes a plurality of multiple annular flameholder gutters downstream of a chamber to mix flow of hot gas flow from a core engine with colder bypass fan air. The disadvantage of such systems is that they require a long mixing length upstream of the conventional annular gutters in order to avoid temperature maldistributions in the gas approaching the multiple annular gutters that could cause instability in the flame front. An example of such an afterburner mix system design is set forth in U.S. Pat. No. 2,978,865 issued Apr. 11, 1961, to E. F. Pierce.

A further approach to afterburner design for jet propulsion engines having fan bypass is the unmixed type which features two separate flameholders for the hot and cold streams, each optimized to suit a local condition. The disadvantage of such unmixed systems is that cold stream combustion requires a relatively complex fuel injection arrangement. Furthermore, flameholders located within the cold stream tend to create a high pressure loss and are of substantial weight. An example of such systems is set forth in U.S. Pat. No. 3,528,250 issued Dec. 23, 1969, to D. Johnson.

An object of the present invention is to provide a short length afterburner assembly having a reduced cold pressure drop under nonafterburning condition without requiring complex fuel injection systems in association therewith and without temperature maldistribution in gas flow approaching flameholders within the short length afterburner duct.

Still another object of the present invention is to provide an improved afterburner construction of short length including improved hot core gas and cold bypass fan air cross-over ducts and including variable geometry swirler means having turbulator vanes located in the cold air cross-over ducts, swirler vanes in a hot core duct and coacting means associated therewith for positioning all vanes parallel to gas flow when the afterburner is off and operative to mix fuel flow directed into the core upstream of the swirler vanes to produce a combination translatory and swirler motion in flow from the hot core passage during afterburner operation and wherein the turbulator vanes are concurrently disposed completely across the cold air cross-over ducts to produce substantial mixing of cold air flow from the bypass ducts into a flame front maintained immediately downstream of the swirler vanes to produce maximized flow turbulence during afterburner operation with enhanced flame propagation by counter-rotating swirl of air and fuel from the swirler vanes.

Still another object of the present invention is to improve afterburner assemblies of the type set forth in the preceding object wherein the swirler vanes and turbulator vanes are interconnected to a shaft system and operative to produce a balanced variable geometry mechanical load thereon to counterbalance aerodynamic forces acting on the turbulator vanes when in a flow restricting position across the cold air bypass passages of the afterburner assembly.

Further objects and advantages of the present invention will be apparent from the following description, reference being had to the accompanying drawings wherein a preferred embodiment of the present invention is clearly shown.

Figure 1:
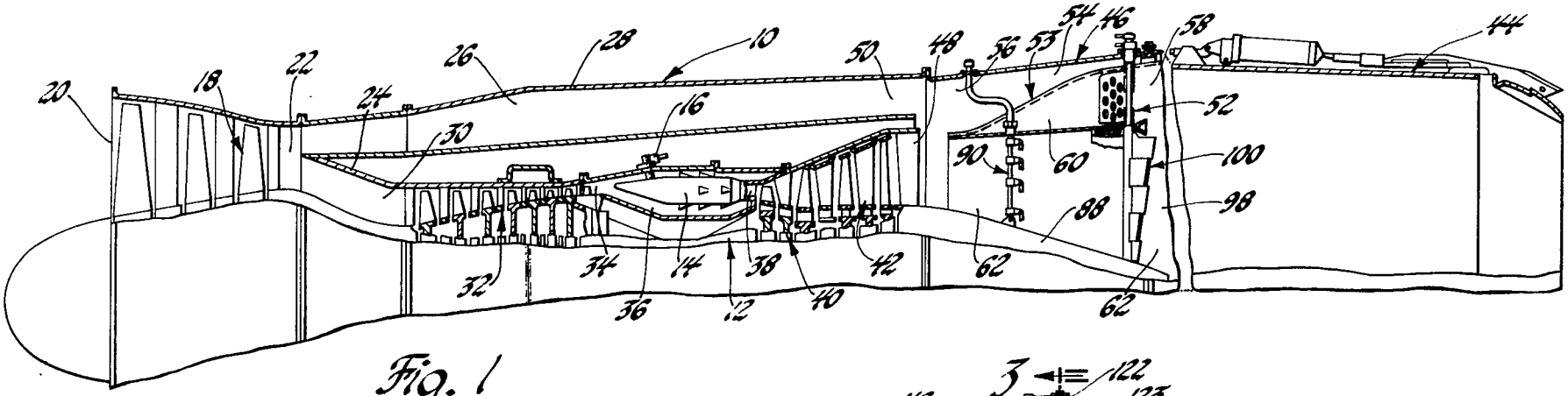
FIG. 1 is a longitudinal cross-sectional view of a fan bypass, jet propulsion engine including a short length afterburner assembly in accordance with the present invention.
Figure 2:
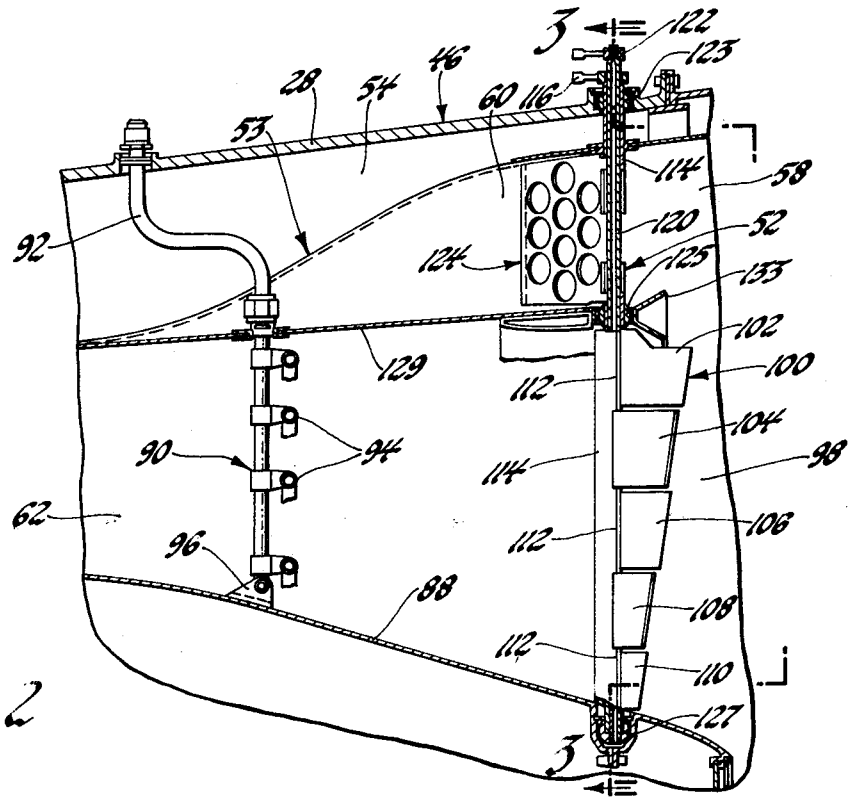
FIG. 2 is an enlarged fragmentary cross-sectional view of the afterburner assembly in FIG. 1 showing hot and cold air stream cross-over ducts associated with improved variable adjustable vane components.

Referring now to FIG. 1, a turbofan jet aircraft propulsion engine 10 is illustrated including a core engine 12 having a combustor 14 with a fuel supply 16 thereto.

Compressed air is directed to the core engine 12 from an upstream, low pressure fan 18 having an inlet 20 and an outlet 22 upstream of flow divider 24 that directs part of the flow pressure fan stage air into an annular bypass duct 26 defined between an outer case 28 and core engine 12. The remainder of the air is directed through an inlet 30 to stages of a high pressure compressor 32 having an outlet 34 in communication with a diffuser chamber 36 for supplying air to the interior of the combustor 14.

Hot gases from the combustor 14 are discharged through an outlet 38 across a high pressure turbine 40 and a low pressure turbine 42 connected by shaft means (not shown) to the high pressure compressor 32 and the low pressure fan 18, respectively. Exhaust is directed to a variable area exhaust nozzle assembly 44. Furthermore, in order to produce power assist during aircraft take-off it is desirable to include an afterburner assembly 46 immediately downstream of an outlet 48 from the core engine 12 and downstream of an outlet 50 from the fan bypass duct 26. Such afterburners desirably are of short length and have a stable combustion over a wide range of operating conditions. Moreover, they should have a high combustion efficiency and a reduced cold air flow pressure drop.

Furthermore, the afterburner should have a cross-over duct, gas mix system to enhance the gas temperature in the flame region of the afterburner assembly 46. Moreover, there should be a uniform temperature profile in gas approaching flameholder components of the afterburner assembly thereby to promote flame stability.

The present invention thereby includes a variable geometry flow controller 52 downstream of a cold-hot gas cross-over duct system 53. It includes an annular cold air duct 54 having an inlet 56 in communication with the outlet 50 from the bypass duct 26 and including an outlet 58 having a plurality of radially outwardly flared, hot gas chutes 60 defining hot air cross-over ducts located circumferentially therearound. Each chute 60 communicates with a hot gas passage 62 of the afterburner assembly 46 which is located immediately downstream of the outlet 48 from the core engine 12 to receive hot gases therefrom.

Figure 4:
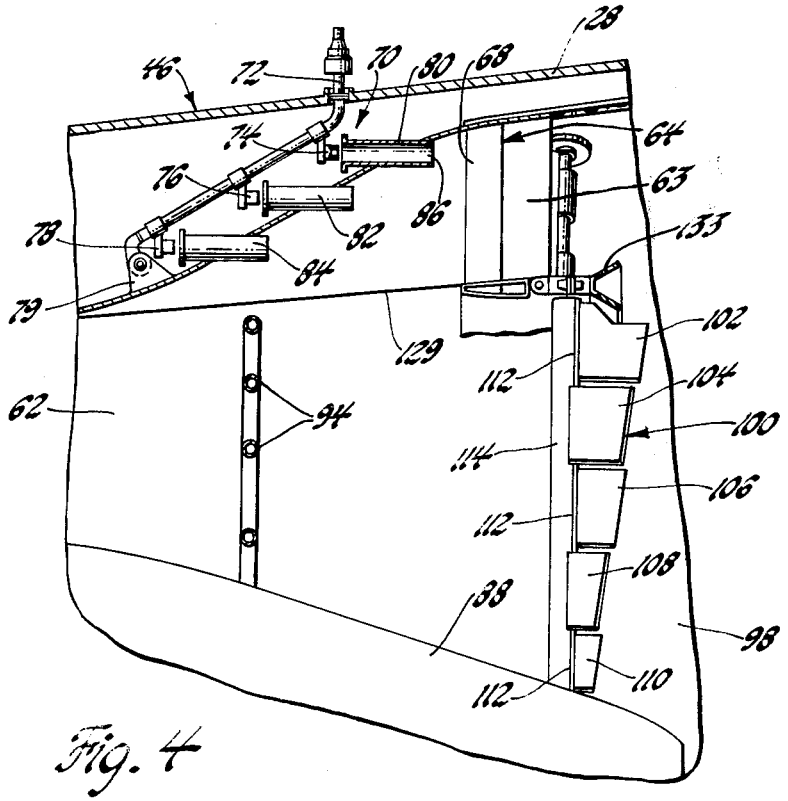
FIG. 4 is a vertical sectional view taken along the line 4—4 of FIG. 3 looking in the direction of the arrows.

Each of the chutes 60 includes an outlet 63 having a flameholder or gutter 64 therein. Each of the gutters 64 are curved to present a concavity 66 downstream of the outlet 63 and to present a convex surface 68 immediately upstream of the outlet 63. Each of the convex surfaces 68 is aligned coaxially with the outlet of an air blast fuel injection system 70. It includes a fuel supply tube 72 having a plurality of outlets in communication with staggered fuel nozzles 74, 76, 78 on a pivot support 79. Each of the fuel nozzles 74, 76, 78 is aligned with an air blast fuel atomization tube 80, 82, 84, respectively, each having an outlet 86 located within chute 60 as is best shown in FIG. 4.

During afterburner operation, air and fuel are mixed and vaporized in each of the air blast fuel atomization systems 70 and are combusted to present a flame front on each of the flameholder gutters 64. This flame front is accordingly located at the outlet 58 from the cold air duct 54. In addition to the chutes 60, hot core gas from the core engine 12 is directed into the annular hot air passage 62 that is formed radially inwardly of the chutes 60 and around an exhaust cone 88.

Figure 3:
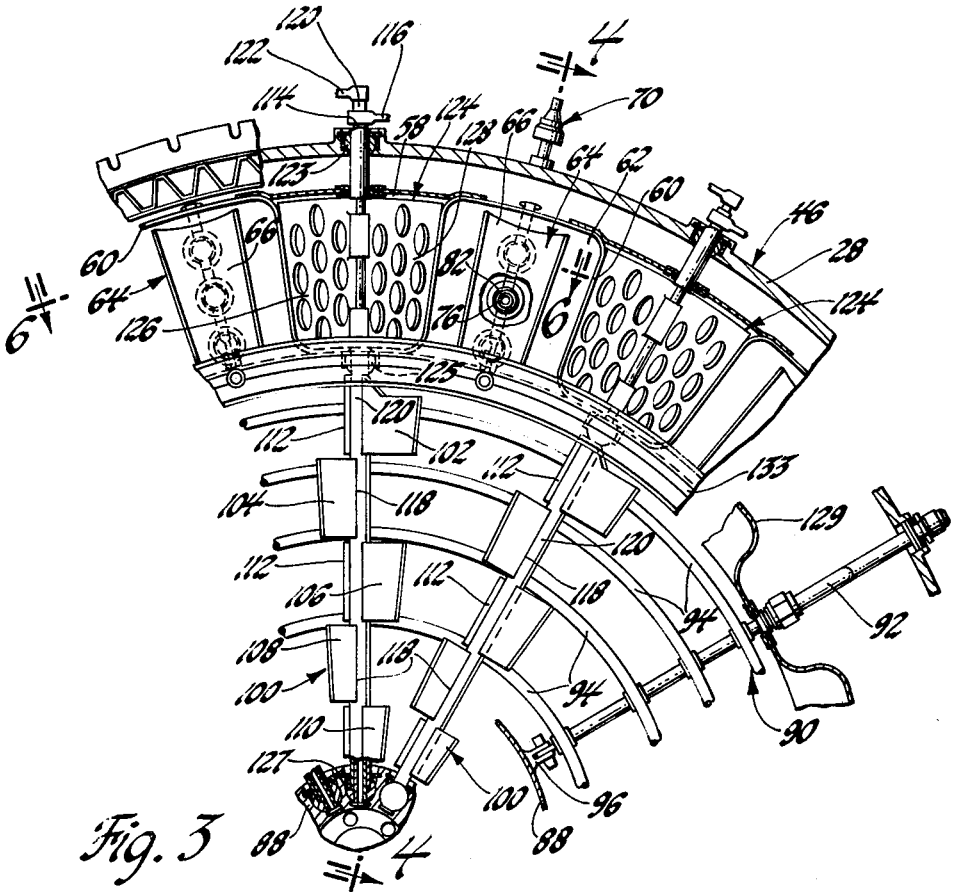
FIG. 3 is a fragmentary vertical sectional view taken along the line 3—3 of FIG. 2 looking in the direction of the arrows.

Afterburner thrust is further enhanced by fuel flow through an inboard fuel distributing manifold 90 with an inlet conduit 92 that supplies a plurality of circular tubes 94 joined to a pivot support 96. Tubes 94 discharge finely atomized fuel into the hot gas passage 62 into the core region 98 of the afterburner 46. This finely atomized fuel is rapidly vaporized in the hot gas stream and passes through a plurality of variable geometry swirler vane assemblies 100 located at circumferentially located points at the outlet of the core passage 62 as best seen in FIG. 3. Each of the assemblies 100 includes a plurality of alternating swirler vanes 102, 104, 106, 108, 110. The vanes 102, 106, 110 each have a tubular edge 112 connected to an outer tubular shaft 114 with an operating lever 116 on one side thereof. Additionally, each of the blades 104, 108 has an edge 118 connected to a shaft 120 telescoped within tubular shaft 114. Shaft 120 has an outboard end connected to an operating lever 122. Shafts 114, 120 are mounted in spaced ball pivot joints 123, 125, 127 for supporting the shafts 114, 120 in the outer case 28, an intermediate wall 129 and cone 88, respectively. The arrangement compensates for thermal expansion between the parts.

During non-afterburner operation, the swirler vanes of the assemblies 100 are positioned parallel to axial gas flow through the passage 62 so as to reduce pressure drop in exhaust flow through the afterburner 46 immediately downstream of the outlet 48.

In addition, a variable geometry turbulator assembly 124 is disposed at the cold air outlet 58 between each of the chutes 60 as shown in FIG. 3. Each of the turbulator assemblies 124 includes a pair of perforated turbulator vanes 126, 128 connected respectively to the operating shafts 114, 120.

Furthermore, each of the vanes 126, 128 is positioned by the shaft 114, 120 parallel to axial flow of gas through the outlet 58 during non-afterburner operation.

Figure 5:
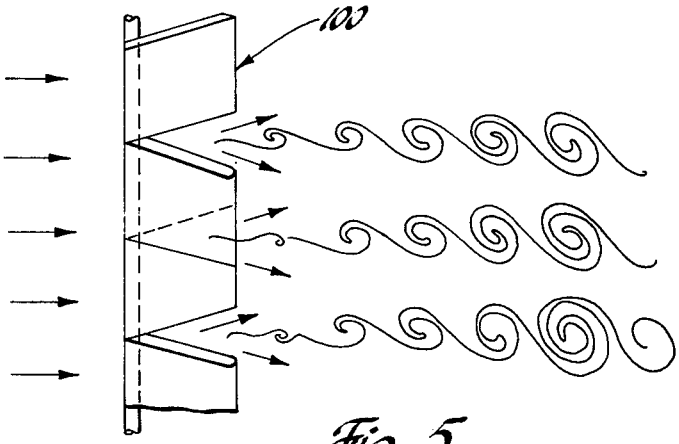
FIG. 5 is a diagrammatic view showing gas motion from swirler vanes.

As shown in FIG. 3 the variable geometry swirler vane assemblies 100 and the turbulator assemblies 124 are moved out of parallel relationship into an interference relationship with axial gas flow through both the passage 62 and the outlet 58 during afterburner operation. The swirler vanes 102-110, as shown in FIG. 3, are moved from a parallel relationship with axial flow and are arranged to intercept axial flow and produce a combination of translatory and swirling motion in axial flow through the passage 62 as it is discharged therefrom along with fuel sprayed from the maniforld 90. An enhanced propagation of the flame is achieved by producing a contra-rotating swirl pattern downstream of vanes 102-110 which is shown in FIG. 5.

Figure 6:
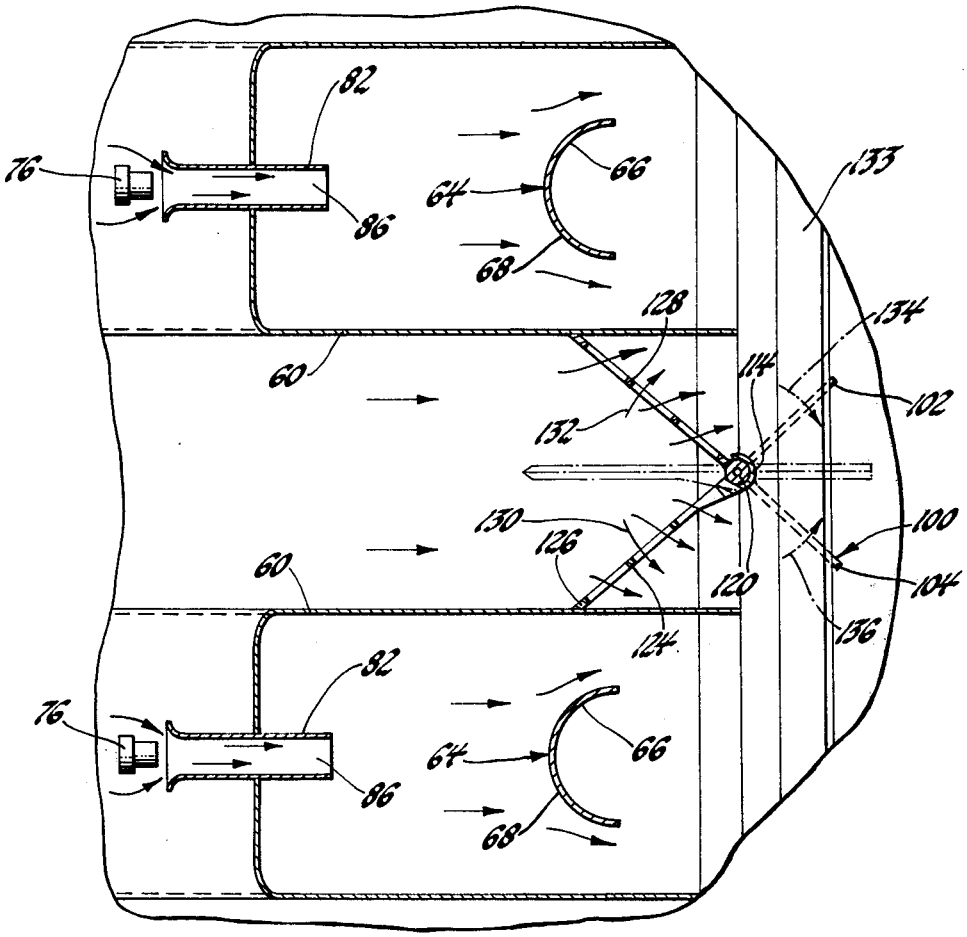
FIG. 6 is a fragmentary sectional view along line 6—6 of FIG. 3 looking in the direction of the arrows.

Concurrently, during afterburner operation hot gas bypass flow through the chutes 60 is interrelated with cold fan air flow at the outlet 58 as shown in FIG. 6. During this operating mode, air blast fuel atomization occurs upstream of each of the flameholders 64 and additionally the perforated turbulator vanes 126, 128 are spread apart to intercept cold air flow from the outlet 58 and to produce a high rate of mixing between the cold air and the hot bypass gas at the flameholder 64. Passage of cold air through the perforated turbulator vanes creates strong turbulence in the combustion zone downstream. Accordingly, high burning rates are achieved so as to maintain unusually stable combustion and to enhance efficiency of combustion within the fan bypass gas region of the afterburner assembly 46. The turbulence downstream of the vanes 126, 128 lacerates and disrupts the flame surface downstream of gutters 64. Thus, surface area is increased and flame propagation rate also is increased. In the illustrated arrangement there is further provided an annular flameholder 122 immediately downstream of the gutters 62 and radially outwardly of the assemblies 100.

A further feature of the present invention is a balanced variable geometry mechanical load system. The turbulator vanes 126, 128 face in an upstream direction as shown in FIG. 6. They direct moments 130, 132 to shafts 114, 120, respectively. Vanes 102 through 110 are faced in a downstream direction. The vanes 102, 106, 110 produce moments 134 to counterbalance the moment 130 and the vanes 104, 108 produce a counterbalance moment 136 to moment 132. Thus, very little mechanical torque is required to change the position of vanes 102 through 110 and vanes 126, 128 from the afterburning to non-afterburning mode and vice versa.

By way of summary, during non-afterburner operation all of the swirler vanes of assemblies 100 are aligned parallel and against one another to present a reduced restriction to flow through the passage 62 to reduce pressure drop at this region of the afterburner. Concurrently, the turbulator vanes 126, 128 are likewise positioned to substantially fully open the outlet passage 58 of the cold air duct 54. Thus, exhaust flow from the core engine 12 and the bypass duct 26 are free to flow through the variable area exhaust duct 44.

However, in order to produce a highly efficient afterburner operation with uniform temperature profiles therein and resultant high fuel burning rates and flame stability the swirler assemblies 100 are positioned during afterburning operation in a spread wing position as shown in FIGS. 3 and 5 to produce both translatory and swirling motion in hot gas flow from the passage 62 which will, along with the flow of fuel from the manifold 90, promote a flame spreading effect into the exhaust duct 44 for enhanced afterburner operation. Concurrently, recognizing the undesirable effect of cold regions within an afterburner, the system of the present invention includes a highly efficient arrangement for crossover of hot air to chutes 60 into which air blast fuel injection flows. This fuel flow is then discharged into a flame holding pattern having cold air flow therethrough acted upon by turbulators in the form of the variably positioned turbulator vanes 126, 128 for creating turbulence to enhance combustion of air blast fuel flow from the systems 70 upstream of each of the flameholder gutters 64.

By virtue of the aforesaid arrangement the overall length of the afterburner assembly is reduced and the weight of the components are reduced.

Furthermore, the systems is highly stable by virtue of the aforedescribed balanced geometry mechanical load system.

While the emodiments of the present invention, as herein disclosed, constitute a preferred form, it is to be understood that other forms might be adopted.

The embodiments of the invention in which an exclusive property or privilege is claimed are defined as follows:

1. An afterburner assembly for a turbofan jet engine with a fan bypass and a core engine comprising an outer annular cold air duct having an inlet connected to the bypass fan discharge and an outlet, an internal core heat exhaust duct having an inlet in communication with the turbojet exhaust and an outlet, chute means forming a plurality of crossover passages communicating the core heat exhaust duct with the cold air duct outlet, means for directing fuel spray into said crossover passages to be vaporized by hot exhaust gas therein, a flameholder in the outlet of each chute means to maintain a flame front at the cold air duct outlet, a pair of perforated turbulator vanes in said outlet for creating turbulence and mixing cold air flow with the flame front at the cold air duct outlet, operator means connected to said turbulator vanes and operative to position said vanes against one another in a straight line position to prevent flow disturbance during normal operation and operative to position said turbulator vanes in a spread-wing position to produce maximized flow turbulence during afterburner operation, and a plurality of swirler vanes located within said internal core gas exhaust duct and connected to said operator means to be positioned to produce a combination translatory and swirl motion flow from said core heat exhaust duct, said swirler vanes being positioned against one another by said operator means in a straight line axial position to permit smooth exhaust flow from said exhaust duct during normal jet engine operation.

2. An afterburner assembly for a turbofan jet engine with a fan bypass and a core engine comprising an outer annular cold air duct having an inlet connected to the bypass fan discharge and an outlet, an internal core heat exhaust duct having an inlet in communication with the turbojet exhaust and an outlet, chute means forming a plurality of crossover passages communicating the core heat exhaust duct with the cold air duct outlet, means for directing fuel spray into said crossover passages to be vaporized by hot exhaust gas therein, a flameholder in the outlet of each chute means to maintain a flame front at the cold air duct outlet, a pair of perforated turbulator vanes in said outlet for promoting turbulence and mixing cold air flow with the flame front at the cold air duct outlet, first and second rotatably adjustable, telescoped shafts connected to said turbulator vanes and operative to position said vanes against one another in an engine straight line position to prevent flow distrubance during normal operation and operative to position said turbulator vanes in a spread-wing position to maximize the flow turbulence during afterburner operation, and a plurality of swirler vanes located within said internal core heat gas exhaust duct to produce a combination translatory and swirl motion in outlet flow from said core heat exhaust duct, said swirler vanes being connected to said telescoped shafts, means including said telescoped shafts for locating said plurality of swirler vanes to produce the combination translatory and swirl motion and to position said swirler vanes against one another in an axial straight line position to permit smooth exhaust flow from said exhaust duct during normal jet engine operation.

3. An afterburner assembly for a turbofan jet engine with a fan bypass and a core engine comprising an outer annular cold air duct having an inlet connected to the bypass fan discharge and an outlet, an internal core heat exhaust duct having an inlet in communication with the turbojet exhaust and an outlet, chute means forming a plurality of crossover passages communicating the core heat exhaust duct with the cold air duct outlet, means for directing fuel spray into said crossover passages to be vaporized by hot exhaust gas therein, a flameholder in the outlet of each chute means to maintain a flame front at the cold air duct outlet, a pair of perforated turbulator vanes in said outlet for promoting turbulence and mixing cold air flow with the flame front at the cold air duct outlet, first and second rotatably adjustable, first and second telescoped shafts connected to said turbulator vanes and operative to position said vanes against one another in an axial straight line position to prevent flow disturbance during normal operation and operative to position said turbulator vanes in a spread-wing position to produce maximized flow turbulence during afterburner operation, and a plurality of swirler vanes located within said internal core heat gas exhaust duct to produce a combination translatory and swirl motion in outlet flow from said core heat exhaust duct, said swirler vanes being connected respectively to said first and second shafts to assume a spread-wing position and to produce a torque thereon to counterbalance aerodynamic forces on said turbulator vanes when in their spread-wing position, said swirler vanes being positioned against one another in an axial straight line position to permit smooth exhaust flow from said exhaust duct during normal jet engine operation.

* * * * *

UNITED STATES PATENT AND TRADEMARK OFFICE

CERTIFICATE OF CORRECTION

PATENT NO. : 4,134,260

DATED : January 16, 1979

INVENTOR(S) : Arthur H. Lefebvre, Samuel B. Reider & Jerry G. Tomlinson

It is certified that error appears in the above-identified patent and that said Letters Patent are hereby corrected as shown below:

| Pat. Col. | Line | |
|---|---|---|
| 4 | 4 | "maniforld" should be -- manifold -- |
| 4 | 27 | "122" should be -- 133 -- |
| 5 | 8 | "systems" should be -- system -- |
| 5 | 11 | "emodiments" should be -- embodiments -- |
| 5 | 40 | after "motion" insert -- in outlet -- (CLM. 1) |
| 6 | 7 & 8 | "distrubance" should be -- disturbance --(CLM. 2) |

Signed and Sealed this

*Eighteenth* Day of *September 1979*

[SEAL]

*Attest:*

*Attesting Officer*

LUTRELLE F. PARKER

*Acting Commissioner of Patents and Trademarks*